United States Patent [19]

Huang

[11] Patent Number: 4,930,264

[45] Date of Patent: Jun. 5, 1990

[54] POLISHING DEVICE

[76] Inventor: Kan-Chi Huang, No. 3 Alley 3, Lane 1512, Chung Shan Road, Tao Yuan City, Taiwan

[21] Appl. No.: 412,482

[22] Filed: Sep. 26, 1989

[51] Int. Cl.[5] ..... B24B 23/02; B24B 55/06

[52] U.S. Cl. ..... 51/170 T; 51/273

[58] Field of Search ..... 51/170 R, 170 T, 273

[56] References Cited

U.S. PATENT DOCUMENTS 4,765,099 8/1988 Tanner ..... 51/170 T

FOREIGN PATENT DOCUMENTS 2542183 4/1976 Fed. Rep. of Germany .... 51/170 T 428280 12/1947 Italy ..... 51/170 T

*Primary Examiner*—Roscoe V. Parker

*Attorney, Agent, or Firm*—Karl W. Flocks

[57] ABSTRACT

The present disclosure is concerned with a grinding type polishing device equipped with a debris-intaking rotor which is disposed in the interior of the polishing device; and on the reverse side of the polishing plate are disposed a plurality of spaced arcuate blade protrusions. By way of the rotation of the polishing plate along with the main shaft, an air pressure differential is produced in the machine so as to permit the sucked debris produced in the grinding process to be moved continuously out of the grinding surface through the debris-intaking roller by centrifugal force via an outlet port. Thereby the debris will not interfere with the further polishing of the surface of the work object.

2 Claims, 4 Drawing Sheets

POLISHING DEVICE

BACKGROUND OF THE INVENTION

The present invention relates to an improved grinding type polishing device equipped with a debris-intaking roller with the top side of the polishing plate provided with a plurality of arcuate blade protrusions which can disturb the air inside an air chamber of the polishing device when rotated at high speed so to produce air pressure differential therein which will get the debris produced in grinding process sucked into the casing of the polishing device and delivered out thereof through an outlet port. The continuous removal of the debris from the grinding surface will help make the work object more readily and better polished.

Generally speaking, to grind and polish a surface of a work object is almost a routine job of machining. Conventional polishing devices are equipped with polishing plates attached with said papers or the like. The polishing plates are actuated by pneumatically driven rotation shafts. During the grinding process, a large amount of debris will be produced and remain on the surface of the work object. The accumulated debris have to be removed after some period of time so that the debris will not interfere with the polishing operation; in other works, the debris may hurt the worked surface and have bad effect on the quality of the polishing result.

The present inventor has noticed the disadvantage of the prior art and worked out an improved polishing device according to the present invention.

SUMMARY OF THE INVENTION

The primary object of the present invention is to provide an improved polishing device which is equipped with a debris-intaking rotor and the polishing plate is provided with a plurality of arcuate blade protrusions on the reverse side thereof. The rotation of the polishing plate can produce air pressure differential in the polishing device so that the debris produced in the grinding process will be sucked thereinto and delivered out of the device through an outlet port at the top cover thereof by a debris-intaking rotor as a result of centrifugal force. Thereby, the surface of the work object will not be damaged by the accumulated debris.

DETAILED DESCRIPTION OF PREFERRED EMBODIMENT

Figure 1:
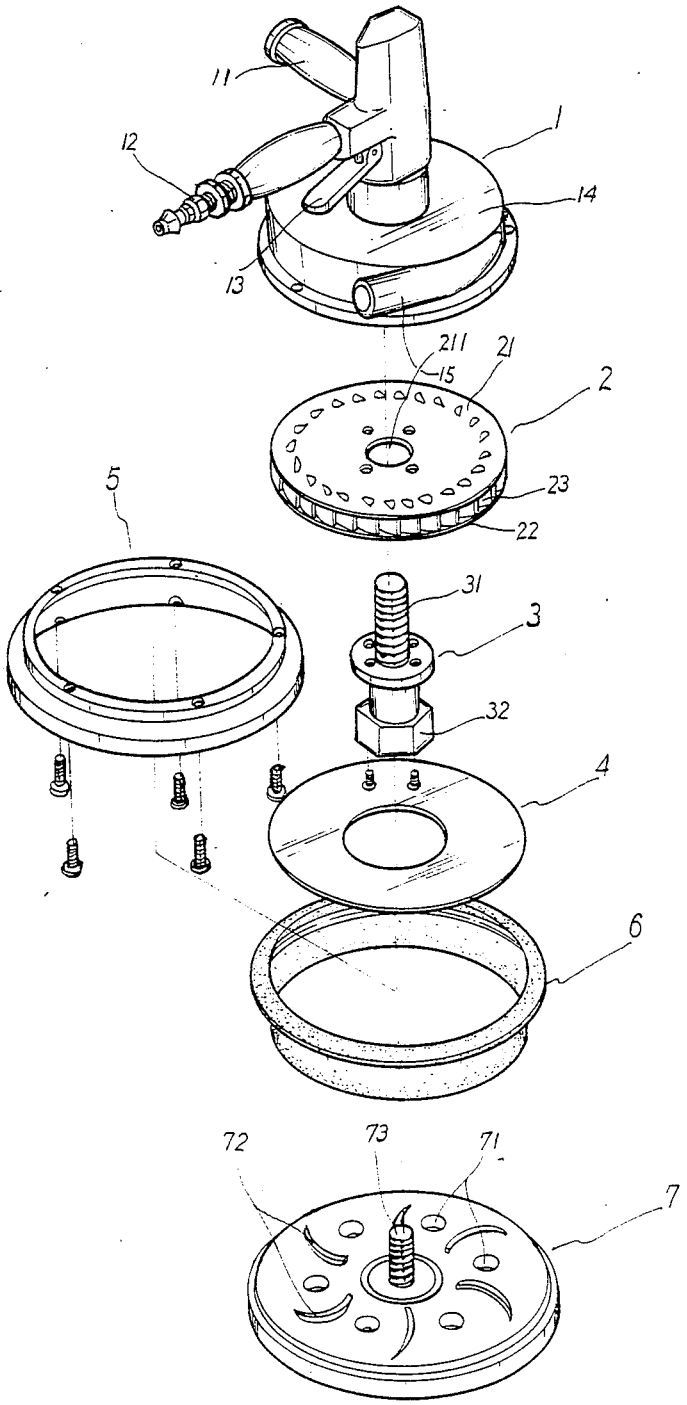
FIG. 1 is a diagram showing the exploded components of the present invention.
Figure 2:
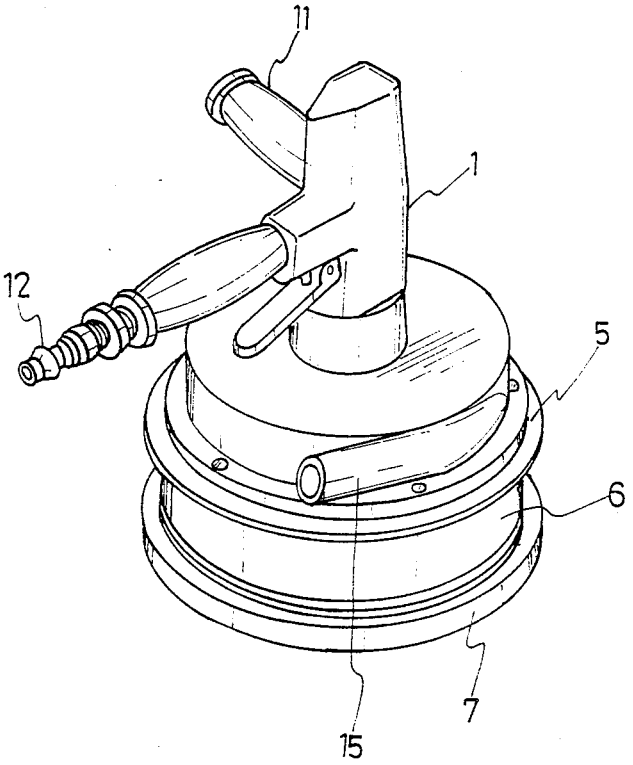
FIG. 2 is a diagram showing the assembly thereof.

Referring to FIGS. 1, 2, the present invention comprises a top cover 1 in connection to a pneumatic means, a debris-intaking rotor 2, a driving shaft 3, a cushion plate 4, an intermediate casing 5, a rubber lower casing 6, and a polishing plate 7.

On the top cover 1 are disposed a handle 11, a high-pressure air inlet 12 with a valve control stick 13 in operative association therewith, which controls the flow of high pressure air into the cover to drive a pneumatic motor (not shown) to operate. And an outlet port 15 extending from the wall of the top cover 1 is used to permit the debris produced in the polishing process to be discharged out of the polishing device therethrough.

A first air chamber 14 is defined in the interior of the top cover 1.

Figure 3:
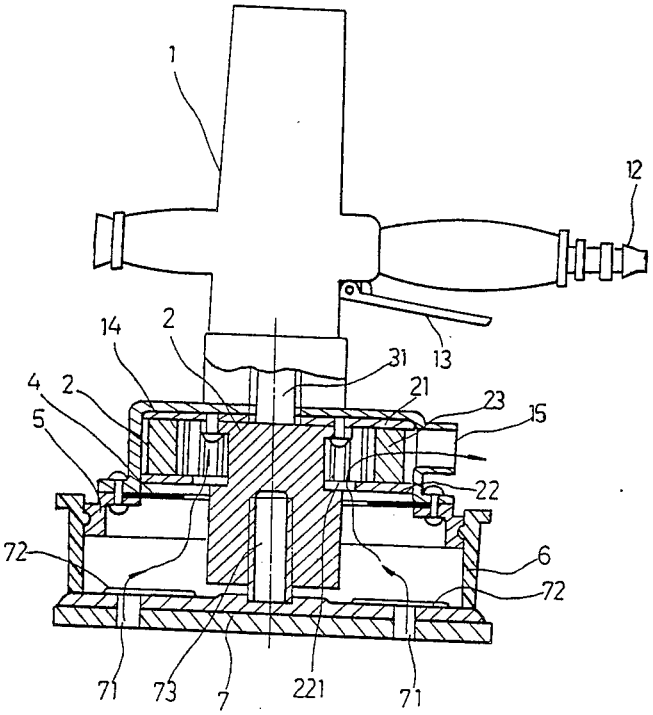
FIG. 3 is a sectional view thereof.

In the first air chamber 14 of the top cover 1 is located a debris-intaking rotor 2 which is mounted on a driving shaft 3 is engaged with the pneumatic motor so that the rotor 2 is able to spin together with the driving shaft 3. The rotor 2 in association with the cushion plate 4 and the intermediate casing 5 is secured to the underside peripheral edge of the top cover 1 by screws; and a lower casing 6 is disposed partially externally of the intermediate casing 5, as shown in FIG. 3, to form a second air chamber. At the bottom of the lower casing is disposed a polishing plate 7. The underside of the polishing plate 7 is provided with a grinding surface for polishing purpose; and there are a number of through holes 71 disposed on the polishing plate 7; on the top surface thereof are evenly disposed a number of arcuate blade protrusions 72. A threaded rod 73 is located at the center of the polishing plate 7 and is engaged with the lower end hole 32 of the driving shaft 3 in assembly.

Referring to FIG. 3, it is clearly illustrated how the individual elements are operatively associated with each other. High pressure air is introduced into the top cover 1 through the air inlet 12 when the valve control stick 13 is put in an open position, so that the pneumatic motor (not shown) is actuated to rotate together with the driving shaft 3. Accordingly, the debris-intaking rotor 2 is made to spin in the air chamber 14 so to produce air pressure differential in the air chamber. At the same time, the polishing plate 7 is driven to move at high speed. The evenly disposed blade protrusions 72 on the other side of the polishing plate 7 can disturb the air in the air chamber so to produce air pressure differential in the second air chamber.

As a result of the air pressure differentials so produced in the first and second air chambers, the air together with debris is sucked into the second chambers defined by the lower casing 6 through the holes 71, and then through the cushion plate 4 into the first air chamber 14.

In the first air chamber 14, the rotating debris-intaking rotor 2 will take in the debris and discharge then through the outlet port 15 of the top cover 1 by centrifugal force.

Figure 4:
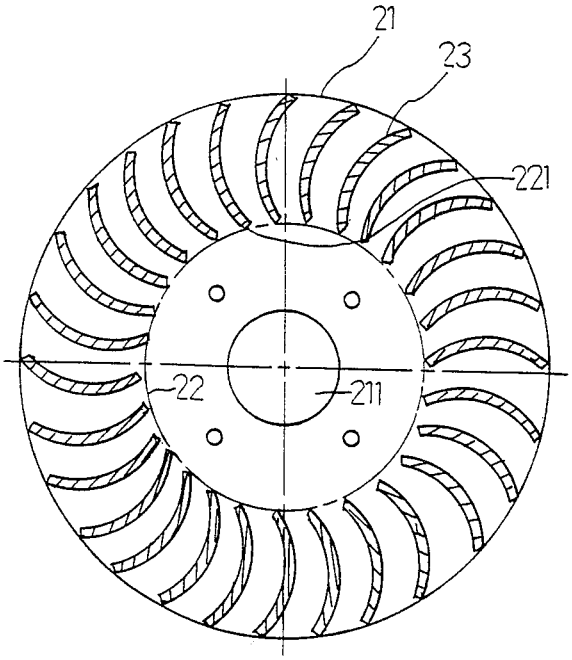
FIG. 4 is a sectional view of the debris-intaking rotor.

The debris-intaking rotor 2 consists of an upper board 21 having a central hole 211 and a lower board 22 having a central hole 221 larger than the hole 211 and a plurality of arcuate blades 23 evenly radially arranged between the upper and lower boards 21, 22 with a distance set between each blade. The diameter of the central hole 221 is preferably set to make the peripheral edge thereof in conformance with the line forming by connection of the end of each arcuate blade. As shown in FIG. 4, the upper board 21 of the rotor 2 is secured to the driving shaft 3 by screws, so that the rotation of the driving shaft 3 can make the rotor 2 spin simultaneously.

I claim:

1. A grinding type polishing device comprising a top cover, a debris-intaking rotor, a driving shaft, a cushion plate, an intermediate casing, a lower casing and a polishing plate; wherein said top cover is equipped with a pneumatically operated motor associated with a high pressure air inlet port through which high pressure air is introduced to actuate said pneumatic motor; a valve control stick is used to control the air flow into said pneumatic motor; said driving shaft is engaged with said pneumatic motor in said top cover; and said debris intaking rotor is attached to said driving shaft and rotates with the same; said cushion plate in cooperation with said intermediate casing is disposed under said top cover to form a first air chamber with said rotor rotatably located therein; said lower casing is disposed partially externally over said intermediate casing so to form a second air chamber with said polishing plate rotatably located therein; said polishing plate having a number of through holes is provided with a central threaded rod which is engaged with the bottom end of said driving shaft so that said polishing plate will rotate therewith; a plurality of spaced arcuate blade protrusions are disposed on the top side of said polishing plate so that when said polishing plate is rotated in said second air chamber, an air pressure differential is produced as a result of the rotation of said polishing plate and said debris-intaking rotor so to permit the debris produced in grinding process to be sucked into the second air chamber through the holes on said polishing plate and into said a first air chamber and moving into said debris-intaking rotor which will discharge the debris out of said top cover by way of centrifugal force through an outlet port on said top cover.

2. A grinding type polishing device as claimed in claim 1 wherein said debris-intaking rotor comprises an upper board and a lower board with a plurality of arcuate blades evenly disposed therebetween in a radial manner; and a central through hole is disposed on said lower board, the diameter of said hole is preferably set to make the peripheral edge thereof in conformance with the line forming by connection of the end of each arcuate blade.

* * * * *